US005091836A

United States Patent [19]

Neustadt

[11] Patent Number: 5,091,836

[45] Date of Patent: Feb. 25, 1992

[54] ELECTRIC LIGHT GLOBE HUB

[76] Inventor: Jerome Neustadt, 5 Holly Ave., Florida, N.Y. 10921

[21] Appl. No.: 709,358

[22] Filed: Jun. 3, 1991

[51] Int. Cl.[5] ..... F21S 1/8

[52] U.S. Cl. ..... 362/391; 362/407; 362/404

[58] Field of Search ..... 362/391, 363, 396, 147, 362/404, 406, 237, 246, 407, 391

[56] References Cited

U.S. PATENT DOCUMENTS 3,253,137 5/1966 Richter ..... 362/293
4,452,836 6/1984 Daniel, Jr. ..... 362/396
4,667,276 5/1987 Cheng ..... 362/249

FOREIGN PATENT DOCUMENTS 122317 of 1900 Fed. Rep. of Germany ..... 362/396
2721310 11/1978 Fed. Rep. of Germany ..... 362/391
148841 12/1952 Netherlands ..... 362/363

*Primary Examiner*—Ira S. Lazarus
*Assistant Examiner*—L. Heyman
*Attorney, Agent, or Firm*—D. Peter Hochberg; Mark Kusner; Louis J. Weisz

[57] ABSTRACT

A globe hub for a casual electric light fixture comprising a cap and a globe holder connectable at a point of joinder by fasteners. Electrical wires extend into the interior of the hub through access openings located at the point of joinder, being connected to a lamp socket held by the globe holder. Wire gripping surfaces extend from the interior of the cap and the globe holder, engaging and anchoring the wiring securely within the hub and allowing stresses imposed thereon to be evenly distributed, thereby avoiding damage to the electrical connection.

14 Claims, 3 Drawing Sheets

ELECTRIC LIGHT GLOBE HUB

TECHNICAL FIELD

This invention relates to globe hubs for electric light fixtures. More particularly, this invention relates to multiple, spaced-apart light fixtures connected to each other by lengths of electrical wiring. Specifically, this invention relates to electric light fixtures interconnected by extendable spiral coils of electrical wiring, especially to those that are suspendable in festoons, and to methods for securely fixing wiring thereto.

BACKGROUND OF THE INVENTION

Casual lighting, that is lighting provided for usually temporary purposes, or lighting provided as an afterthought in particular locations, is commonly required or desirable in a variety of applications. Such lighting, for example, is oftentimes used at cookouts, for pool or patio parties, as well as at campsites, and is sometimes attached to the outside of stationary recreational vehicles. Beyond such temporary uses, however, casual lighting is also often resorted to for illumination in more permanent settings, for instance, in basements, game rooms, at job sites, and the like.

Such lighting is of considerable convenience in such situations since it is portable and can be rapidly installed without any need for more permanent fixtures or wiring. It is also easily removed when no longer required. Casual lighting lends itself to installation in areas and in positions in which the provision of more permanent lighting would be impractical, undesirably expensive, or unfeasible.

While casual lighting is a considerable convenience in many situations, it is not without attendant problems resulting from its temporary nature. For example, it is typically free-standing, that is, it is not "hard-wired" to fixtures anchored to ceilings or walls, or equivalent permanent structures, but rather is loosely attached or temporarily suspended from supports and it normally involves exposed wiring. While such disposition facilitates deployment of the lights, it also makes them more vulnerable to accidents in which severe strains can be imposed on the points at which the wiring is connected to the lights. In addition, in instances where the lights are suspended only by their own wiring, the weight of the lights themselves results in such strains. When subjected to stresses and strains of the type described, wiring used in the lights' electrical connections can become disconnected or otherwise damaged, sometimes resulting in an inconvenient failure of the lights, or in more serious cases, to exposure of individuals coming in contact therewith to electrical shock.

These possibilities have led to design modifications in such lights for the purpose of the type described typically comprise structures, or "hubs", into which electrical lamps are screwed, and which are connected to wiring extending into one or both sides thereof. Commonly, globes are positioned about the lamps, being held by the hubs, both to better diffuse the light emitted therefrom, as well as to provide a more decorative appearance to the fixtures. In the past, the strengthening referred to has involved the fashioning of the top of the hubs in the shape of a rigid "T", the electrical wiring being inserted in the horizontal arms thereof, which hold and protect it. The expedient described is not altogether effective in providing protection to the connections, however, and it unfortunately detracts from the aesthetic qualities of the lights. In this regard, lights of the type described are not simply functional, but in many instances, are intended to be decorative as well. However, when hubs shaped as described are used, they tend to impart an unattractive geometric, rather stiff appearance to the lights, as well as to interfere with their disposition in graceful festoons.

BRIEF DESCRIPTION OF THE INVENTION

In view of the preceding, therefore, it is a first aspect of this invention to provide a globe hub for a casual light fixture that is attractive, as well as functional.

It is a second aspect of this invention to provide a globe hub for a casual light fixture that protects the electrical wiring connected thereto from becoming accidentally disconnected.

An additional aspect of this invention is to provide a globe hub for casual light fixtures that allows the fixtures to be hung in graceful festoons.

Another aspect of this invention is to provide a globe hub for a casual light fixture that facilitates the secure attachment of electrical wiring thereto.

A further aspect of this invention is to provide a globe hub for a casual light fixture that allows electrical wiring to be attached to the hub both rapidly and easily.

Yet another aspect of this invention is to provide a globe hub for a casual light fixture that prevents the inadvertent detachment of electrical wiring therefrom.

Still an additional aspect of this invention is to provide a globe hub for a casual light fixture whose connection to the wiring supplying electricity thereto is sufficiently sturdy to withstand significant amounts of stress placed thereupon.

The foregoing and other aspects of the invention are provided by a globe hub for a casual electric light fixture comprising a cap connectable to the top of a globe holder as a cover therefor. The cap and the globe holder are provided with openings therein adapted to receive electrical wiring therethrough for connection to an electric lamp held in the hub. The cap and the holder are also provided with a plurality of gripping surfaces extending from interior surfaces thereof, adapted to hold and immobilize electrical wiring in contact therewith.

The foregoing and additional aspects of the invention are provided by a globe hub for a casual electric light fixture comprising a circular cap in the form of a hollow cylinder substantially closed on its upper end and having a rim whose open lower end is provided with a grooved annular surface having at least one semicircular opening therein. The cap has two spaced-apart lugs extending downwardly from the lower surface of its closed upper end, the lugs having outwardly facing shoulders thereon.

The hub also includes a globe holder having an upper hollow cylindrical portion with an additional grooved annular surface provided with at least one semicircular opening therein. The upper cylindrical portion is substantially closed on its lower end, while the substantially closed lower end has an opening therein. Means are provided for attaching the cap to the globe holder, and when so attached, the annular surface of the cap and globe holder are adapted to engage each other in a mating relationship so that the semicircular openings are aligned and the lugs extend through the opening. When so disposed, electrical wiring extending through the semicircular openings and through the hole in contact with the shoulders is immobilized.

The foregoing and further aspects of the invention are provided by a globe hub for a casual electric light fixture comprising a circular cap including a hollow cylinder substantially closed on its upper end, the rim of the lower end being provided with a grooved annular surface having at least one semicircular opening therein furnished with a raised ridge. The cap has two spaced-apart lugs and also raised ridges extending downwardly from a lower surface of the closed upper end, the lugs having outwardly facing, stepped shoulders thereon.

The hub is also provided with a globe holder having an upper hollow cylindrical portion having a grooved annular surface with at least one semicircular opening therein provided with a raised ridge. The upper cylindrical portion is substantially closed on its lower end, the substantially closed lower end having an opening therein and raised ridges extending upwardly therefrom. The cap and the globe holder are attached to each other by threaded fasteners, and when so attached, their annular surfaces are adapted to engage each other, the lugs extending through the opening so that electrical wiring passing through the semicircular openings and through the hole in contact with the shoulders and the raised ridges is immobilized.

BRIEF DESCRIPTION OF THE DRAWINGS

The invention will be better understood when reference is had to the following drawings in which like-numbers refer to like-parts, and in which.

DETAILED DESCRIPTION OF THE INVENTION

Figure 1:
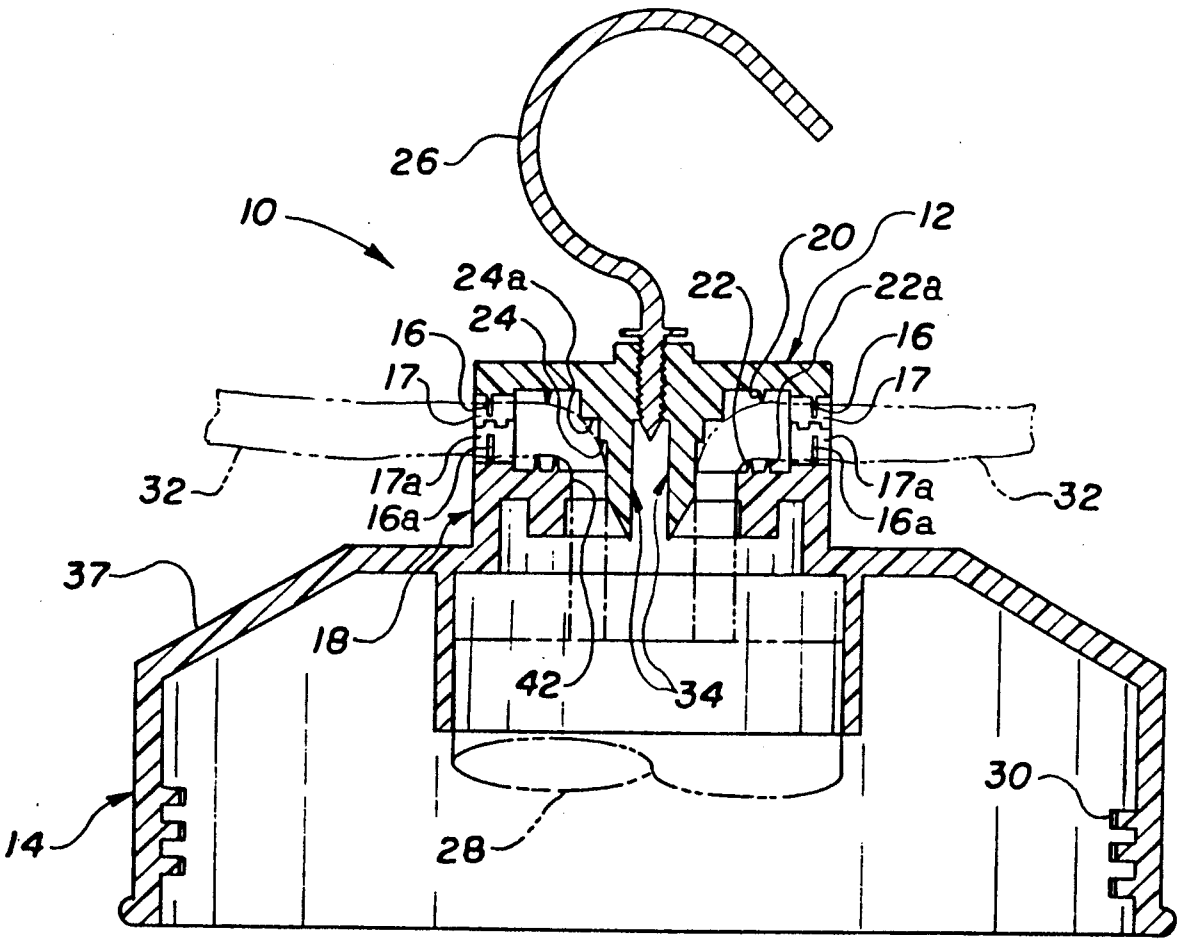
FIG. 1 is a cross-sectional view of the globe hub for a casual light fixture of the invention taken through the center of the hub along a centerline corresponding to the axis of the openings through which the wires enter the fixture.

FIG. 1 is a cross-sectional view of the globe hub of the invention taken through the center of the hub. As illustrated, the hub, generally 10, consists of a cover cap, generally 12, and a globe holder, generally 14. The cap 12 comprises a hollow cylinder, closed on the top and open on the bottom, having semicircular openings 17 aligned along the horizontal axis of the cap, on either side thereof. The openings 17 are provided with a raised ridge 16 which serves to grip electric wiring 32, shown in phantom, extending therethrough.

The cap 12 is also provided with spaced-apart lugs 34 extending downwardly from the top of the cap, and having outwardly facing shoulders 24 and 24*a*, which also serve to grip the wiring 32. Further, the top of the cap 12 has a raised ridge 20 projecting downwardly from the lower surface of the cap, providing a still further gripping action on the wiring 32. A hanger hook 26 extends from the top of the cap 12, allowing the globe hub 10 to be suspended from a suitable support.

Figure 2:
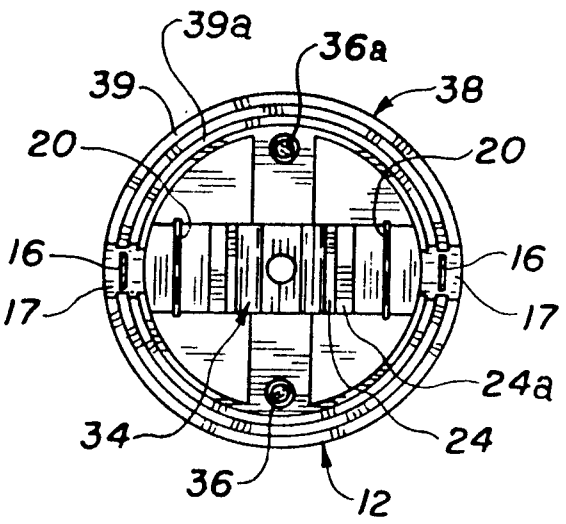
FIG. 2 is a bottom view of the cover cap of the globe hub of FIG. 1.
Figure 3:
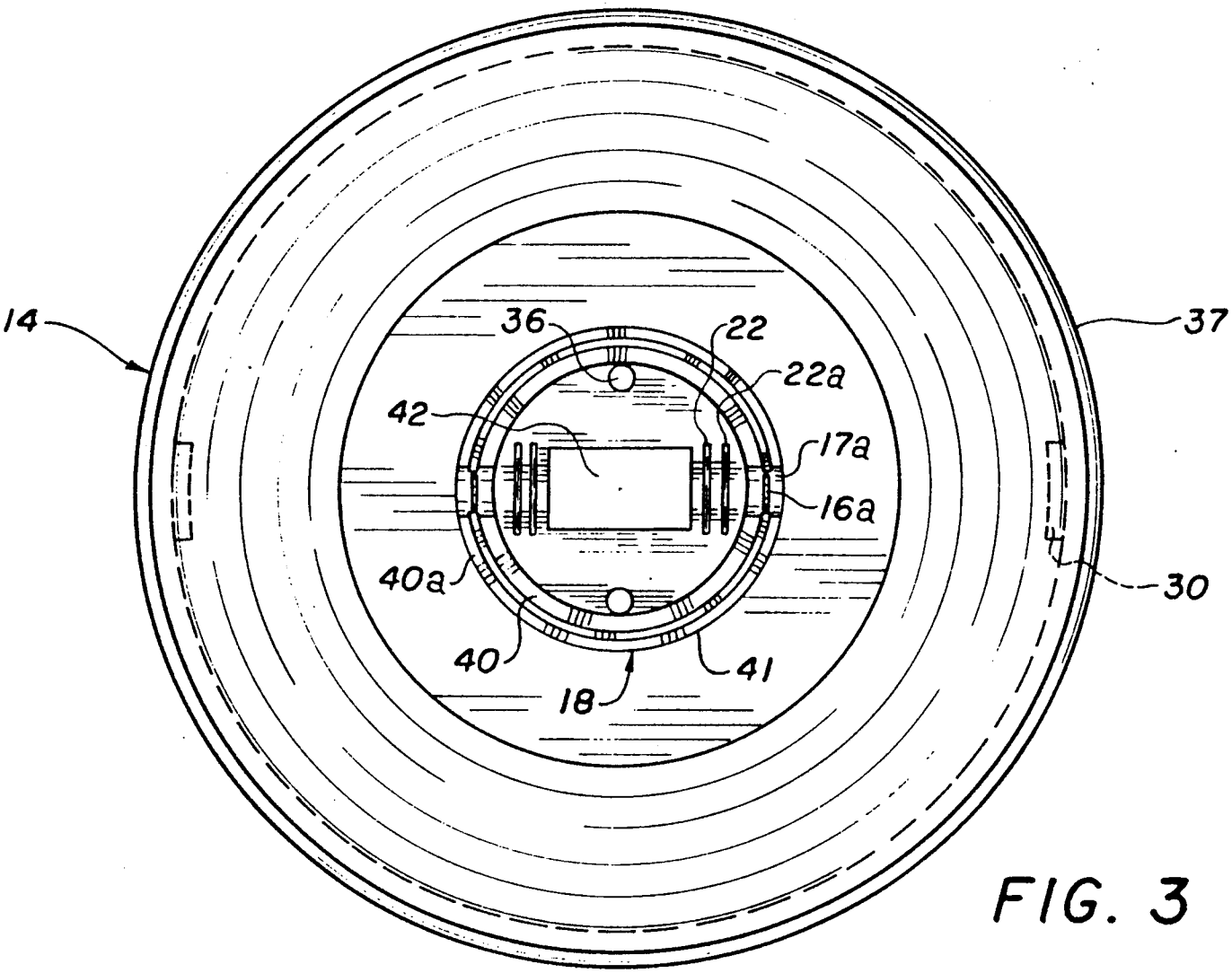
FIG. 3 is a top view of the globe holder of the globe hub of FIG. 1.

Fastened to the cap 12 by threaded fasteners whose location is better seen in FIGS. 2 and 3 is a globe holder 14. The globe holder includes an upper hollow cylindrical portion, also provided with semicircular openings 17*a* having a raised ridge 16*a* extending therefrom for the purpose of gripping the wiring, and raised ridges 22 and 22*a* which supplement the gripping action.

In the process of attaching the wires, the cap 12 is disassembled from the globe holder 14 by removal of the fasteners referred to, and electrical wiring is introduced through semicircular openings 17*a*, over raised ridges 22 and 22*a*. The wiring is then forced downwardly through an opening 42 in the substantially closed lower end of the upper hollow cylindrical portion 18 of globe holder 14, and is electrically connected to the bulb holder 28. The cap 12 is then placed in position over the electrical wiring and connected to the globe holder 14 by means of the aforesaid fasteners. When so positioned, the raised ridges 16, 16*a*, 20, 22 and 22*a*, and the lug shoulders 24 and 24*a* grippingly engage the wiring. The cumulative effect of the shoulders, the raised ridges, and the threading of the wiring through opening 42 is to so securely fasten the wiring to the globe hub 10 that the connected structure is able to support a significant deadweight, i.e., depending upon the type of wiring and the dimensions of the globe hub components, up to about 35 pounds.

Following assembly as described, an electric lamp can be inserted in the lamp holder 28 and a globe mounted in the lower cylindrical portion 37 of the globe holder 14, for example, by means of threads 30.

FIG. 2 is a bottom view of the cover cap of the globe hub of FIG. 1. The Figure shows the axially aligned semicircular wiring openings 17, including the raised ridges 16 provided therein, located in the annular sealing rim 38 of the cap. The rim 38 is provided with annular grooves 39 and 39*a* for the purpose of matingly engaging counterpart grooves in the rim 41 of globe holder 14. Lugs 34, with shoulders 24 and 24*a*, and raised ridge 20 can be seen extending downwardly from the lower surface of the cap. Fastener holes 36 are provided to accommodate the connecting fasteners 36*a*, as previously described, and the grooves 39 and 39*a* serve the purpose of providing a weatherproof seal between the cap 12 and the globe holder 14. While one ridge 20 is shown, additional ridges can be provided, if desired. In like manner, while two lug shoulders 24 and 24*a* are illustrated, additional shoulders can be furnished where added support is required.

The dimensions of the cap 12 are not critical; however, its diameter will typically be from about 1½ inch to 1¼ inch, while the lugs will be about ½ inch high and ⅜ inch wide.

FIG. 3 is a top view of the globe holder of the globe hub of FIG. 1. Shown in the Figure is the upper cylindrical portion of the globe holder 18, and its rim 41. The rim 41 contains grooves 40 and 40*a* provided for weather-sealing purposes, as previously indicated. The rim also includes semicircular openings 17*a* provided with a raised ridge 16*a* for gripping wiring extending through the openings. Raised ridges 22 and 22*a* extend upwardly from the substantially closed lower end of the upper cylindrical portion, and an opening 42 is provided for entry of the lugs 34, as well as the wiring 32.

The lower cylindrical portion 37 of the globe holder 14 is also shown, including the globe holder threads 30. Fastener holes 36 allow attachment of the globe holder to the cap, as previously described.

As in the case of the rim 28 of cap 12, the number of grooves in the rim 41 can be altered and greater or fewer raised ridges 22 and 22*a* may be furnished.

The dimensions of the upper cylindrical portion 18 will be compatible with the dimensions of the cap 12, and the access opening 42 will commonly be about ⅜ inch wide, and about ½ inch long. The semicircular holes 17*a* will have dimensions matching those of semicircular holes 17, and will depend upon the cross-sectional dimension of the wiring. Frequently, the semicircular holes will be about 3/16 inch in diameter, and the rims 38 and 41 will be about ⅛ inch wide.

Figure 4:
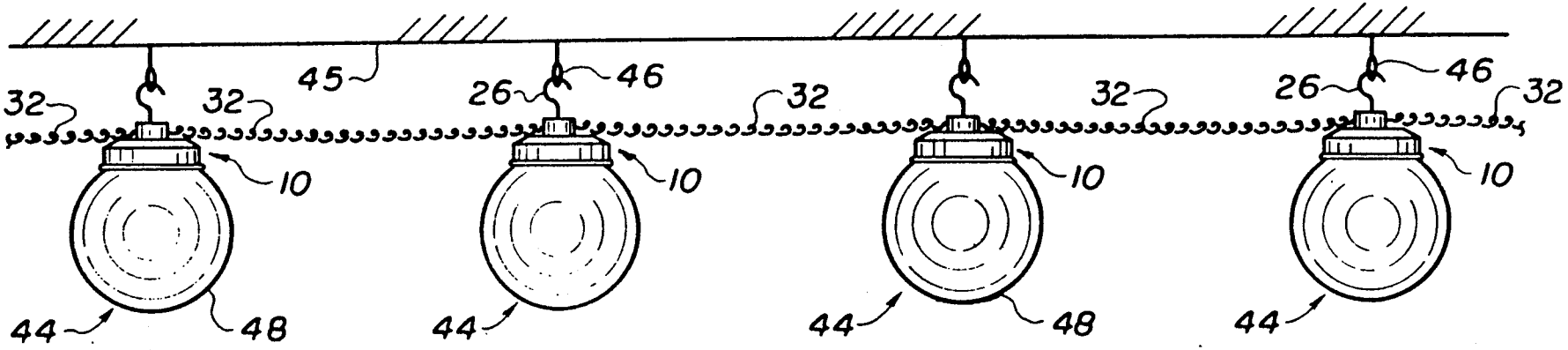
FIG. 4 is a pictorial view of a festoon of casual lights utilizing globe hub fixtures of the invention.

FIG. 4 is a pictorial view of a festoon of casual lights utilizing globe hub fixtures of the invention. In the Figure, the festoon 44 shown consists of globe hubs 10 in which globes 48 are mounted suspended by hanger hooks 26 which engage hook eyes 46 attached to a ceiling 45. The globe hubs 32 are connected by extensible spiral coils of electrical wiring 32. The number of lights can be varied, depending upon the electrical characteristics of the circuit into which the festoon is connected and the wattage of the lamps being connected thereto. Usually, from about 6 to 8 lights of 60 watts each will be thus interconnected, although more or less than that number can be joined.

The globe hub can be formed from either metal or plastic; however, plastic is preferable particularly because of its dielectric characteristics. Plastics such as polyvinyl chloride, i.e., PVC; ABS; polystyrene, or others may be employed for the purpose. With respect to the globes, these will advantageously be made from a shatterproof plastic such as, for instance, polycarbonate, although other transparent or translucent materials can also be used.

Cord lengths can be varied to suit requirements of the application, four foot lengths of spiral coiled wire being common. The diameter of the globes can also be varied; however, globes of six to eight inches in diameter have been found to be well suited for the purpose.

Globe hubs of the type described in the preceding are especially valuable in fabricating strings of casual lights since the multiple points of gripping connection described allow strains imposed thereon to be distributed proportionately across the length of the connection, avoiding concentrated points of stress in the connection, and therefore, allowing greater stress loading than would otherwise be possible, without damage to the wiring.

While in accordance with the patent statutes, a preferred embodiment and best mode has been presented, the scope of the invention is not limited thereto, but rather is measured by the scope of the attached claims.

What is claimed is:

1. A globe hub for a casual electric light fixture comprising a cap connected to the top of a globe holder as a cover therefor, said cap and said holder being provided with openings adapted to receive electrical wiring therethrough for connection to an electric lamp held in said hub, said cap and said holder also being provided with a plurality of gripping structures extending from interior surfaces thereof adapted to force electrical wiring to be connected to said fixture to bend within said fixture at right angles, thereby enabling said structures to hold and immobilize said electrical wiring in contact therewith.

2. A globe hub for a casual electric light fixture according to claim 1 wherein said cap has raised ridges and two spaced apart lugs extending downwardly therefrom, said lugs having outwardly facing shoulders thereon, and said globe holder having an opening therein adapted to receive said lugs, and raised ridges extending upwardly therefrom, said ridges and said shoulders comprising said gripping structures wherein wires supplying said fixture with electricity are inserted into said fixture between said cap and said holder and are bent at right angles as they enter said opening, being immobilized by said structures.

3. A globe hub for a casual electric light fixture comprising a circular cap including a hollow cylinder substantially closed on its upper end, the lower end of whose rim is provided with a first grooved annular surface having at least one semicircular opening therein, said cap having two spaced apart lugs extending downwardly from a lower surface of its substantially closed upper end, said lugs having outwardly facing shoulders thereon;

a globe holder with an upper hollow cylindrical portion, the upper end of whose rim has a second grooved annular surface with at least one semicircular opening therein, said upper cylindrical portion being substantially closed on its lower end but having a bottom opening therein; and means for attaching said cap to said globe holder, wherein when said cap and said globe holder are attached, said first surface is adapted to engage said second surface, said semicircular openings being substantially axially aligned, and said lugs extending through said opening so that electrical wiring supplying said electric light fixture with electricity and extending through said semicircular openings, and through said hole in contact with said shoulders is bent at right angles as it enters said bottom opening and is immobilized.

4. A globe hub according to claim 3 wherein said semicircular openings are provided with a raised ridge, and a lower surface of the closed upper end and an upper surface of the closed lower end also have raised ridges extending therefrom, said ridges and said shoulders being located in substantially parallel planes and being disposed in substantial alignment with each other, and being adapted to grip said electrical wiring.

5. A globe hub according to claim 4 wherein said attachment means are threaded fasteners.

6. A globe hub according to claim 5 wherein said globe holder is provided with a lower hollow cylindrical portion adapted to hold a lamp socket and a globe therein.

7. A plurality of globe hubs for casual electric light fixtures according to claim 3 interconnected by electric wiring.

8. A globe hub according to claim 3 wherein said cap is provided with hanging means.

9. A globe hub for a casual electric light fixture comprising a circular cap including a hollow cylinder substantially closed on its upper end, the rim of the lower end of said cylinder being provided with a first grooved annular surface having at least one semicircular opening therein furnished with a raised ridge, said cap having two spaced-apart lugs and raised ridges extending downwardly from a lower surface of its closed upper end, said lugs having outwardly facing, stepped shoulders thereon; and a globe holder with an upper hollow cylindrical portion having a second grooved annular surface with at least one semicircular opening therein provided with a raised ridge, said upper cylindrical portion being substantially closed on its lower end but having an opening therein and raised ridges extending upwardly therefrom, said cap and said globe holder being connectable to each other by threaded fasteners, wherein when so connected, said first surface is adapted to engage said second surface, and said lugs extend through said opening so that electric wiring extending through said semicircular openings, and through said hole in contact with said shoulders and said raised ridges are immobilized.

10. A globe hub according to claim 9 wherein said globe holder is provided with a lower hollow cylindrical portion adapted to hold a lamp socket and a globe therein.

11. A plurality of electric light fixtures having globe hubs according to claim 10 provided with hanging means and interconnected with spiral coil electrical wiring.

12. A globe hub for a casual electric light fixture comprising a cap connected to the top of the globe holder as a cover therefore, said cap and said holder being provided with openings adapted to receive electrical wiring therethrough for connection to an electric lamp held in said hub, said cap and said holder also being provided with a plurality of gripping structures extending from interior surfaces thereof adapted to hold and immobilize electric wiring and contact therewith, wherein said cap has raised ridges and two spaced apart lugs extending downwardly therefrom, said lugs having outwardly facing shoulders thereon, and said globe holder having a opening therein adapted to receive said lugs, and raised ridges extending upwardly therefrom, said ridges and said shoulders comprising said gripping structures.

13. A globe hub for a casual electric light fixture comprising a circular cap including a hollow cylinder substantially closed on its upper end, the rim of the lower end of said cylinder being provided with a first grooved annular surface having at least one semicircular opening therein furnished with a raised ridge, said cap having two spaced apart lugs and raised ridges extending downwardly from a lower surface of its closed upper end, said lugs having outwardly facing, stepped shoulders thereon; and a globe holder with an upper hollow cylindrical portion having a second grooved annular surface with at least one semicircular opening therein provided with a raised ridge, said upper cylindrical portion being substantially closed on its lower end but having a bottom opening therein and raised ridges extending upwardly therefrom, said cap and said globe holder being connectable to each other by threaded fasteners.

wherein when so connected, said first surface is adapted to engage said second surface, and said lugs extend through said openings so that electric wiring extending through said semicircular openings, and through said bottom opening in contact with said shoulders and said raised ridges is immobilized, and wherein said globe holder is provided with a lower hollow cylindrical portion adapted to hold a lamp socket and a globe therein.

14. A plurality of electric light fixtures having globe hubs according to claim 13 provided with hanging means and interconnected with spiral coil electrical wiring.

* * * * *